US006612883B2

(12) United States Patent
Gokan et al.

(10) Patent No.: US 6,612,883 B2
(45) Date of Patent: Sep. 2, 2003

(54) OUTPUT SHAFT STRUCTURE OF PERSONAL WATERCRAFT

(75) Inventors: Yoshitsugu Gokan, Saitama (JP); Tomohiro Fuse, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/199,037

(22) Filed: Jul. 22, 2002

(65) Prior Publication Data

US 2003/0032345 A1 Feb. 13, 2003

(30) Foreign Application Priority Data

Jul. 31, 2001 (JP) ..... 2001-231355

(51) Int. Cl.[7] ..... B63H 23/34
(52) U.S. Cl. ..... 440/83; 440/89
(58) Field of Search ..... 440/83, 111, 112, 440/52, 75, 89, 38

(56) References Cited

U.S. PATENT DOCUMENTS 4,929,204 A * 5/1990 Shiozawa ..... 440/112

FOREIGN PATENT DOCUMENTS

JP 2880691 1/1999

OTHER PUBLICATIONS

Patent Abstracts of Japan, Publ. No. 2001140641 A (JP 2001–140641 A), May 22, 2001, "Small Boat", Yoshiji Gokan et al.

* cited by examiner

*Primary Examiner*—Ed Swinehart
(74) *Attorney, Agent, or Firm*—Birch, Stewart, Kolasch & Birch, LLP

(57) ABSTRACT

To prevent the dispersal of water in a watercraft body, prevent interference of a coupler with piping, and prevent deterioration of the piping. An engine is mounted on a watercraft body with a crankshaft of the engine extending along the longitudinal direction of the watercraft body and a shaft of a jet pump is coupled via a coupler to a rear end of the crankshaft in such a manner so as to be disposed on an extension of the crankshaft. A coupler cover is provided for covering the coupler, and piping for cooling water, which is in communication with the jet pump, is fixed onto the coupler cover. A turbo-charger is disposed over the coupler, and the piping is fixed on the coupler cover at a position between the coupler cover and the turbo-charger. The coupler cover is turnable around the shaft.

10 Claims, 12 Drawing Sheets

OUTPUT SHAFT STRUCTURE OF PERSONAL WATERCRAFT

CROSS-REFERENCE TO RELATED APPLICATIONS

The present application claims priority under 35 USC 119 to Japanese Patent Application No. 2001-231355 filed on Jul. 31, 2001 the entire contents thereof is hereby incorporated by reference.

BACKGROUND OF THE INVENTION

1. Field of the Invention

The present invention relates to an output shaft structure of a personal watercraft.

2. Description of Background Art

Personal watercrafts of a type shown in FIG. 12 have been known, wherein an engine 1 is mounted on a watercraft 2 with a crankshaft 1*a* of the engine 1 extending along the longitudinal direction of the watercraft body 2, and a shaft 3*a* of a jet pump 3 is coupled via a coupler 4 to an rear end 1*b* of the crankshaft 1*a* in such a manner as to be disposed on an extension of the crankshaft 1*a*.

In these personal watercrafts, power from the crankshaft 1*a* of the engine 1 is transmitted to the jet pump 3 via the shaft 3*a,* to propel the watercraft body 2.

The above-described personal watercrafts have been frequently used for the purpose of enjoying leisure sport, and as a result of immoderate running of the watercrafts, water may be somewhat permeated in the watercraft body 2.

Accordingly, in the above-described related art personal watercraft, there has arisen a problem that water permeates into the watercraft body 2 and comes in contact with the coupler 4, is dispersed in the watercraft body 2 by a centrifugal force of the coupler 4 having a diameter larger than that of each of the crankshaft 1*a* and the shaft 3*a*.

Further, in the personal watercrafts of this type, piping for taking off cooling water is connected to a portion, on the upstream side from an impeller, of the jet pump, and cooling water is supplied to the engine or the like via the piping. As a result, there problems have arisen wherein the piping may interfere with the coupler 4 having a large diameter, and that the piping is liable to deteriorate due to the fact that the piping is exposed to water (particularly, sea water) dispersed by the centrifugal force of the coupler 4.

SUMMARY AND OBJECTS OF THE INVENTION

Accordingly, a first object of the present invention is to solve the above-described problems and to provide an output shaft structure of a personal watercraft, which is capable of preventing the dispersal of water in a watercraft body, preventing interference of piping with a coupler, and preventing the piping from deteriorating.

Two-cycle engines have been used as power sources of general personal watercrafts. However, in recent years, to meet a requirement to lower environmental pollution, personal watercrafts using four-cycle engines as power sources have been proposed (Japanese Patent No. 2880691).

Outputs of four-cycle engines are smaller than those of two-cycle engines as compared with the same displacement, and to cope with such an inconvenience, it has been examined to develop personal watercrafts in which engines with turbo-chargers are mounted. For example, the present inventor has already proposed, in Japanese Patent Laid-open No. 2001-140641, a personal watercraft in which an engine with a turbo-charger is mounted.

A turbo-charger has a relatively large weight, and therefore, from the viewpoint of keeping a good weight balance of a watercraft, the turbo-charger may be desired to be provided near an engine, more specifically, immediately behind the engine. Even in Japanese Patent Laid-open No. 2001-140641, a turbo-charger is disposed immediately behind an engine 2, and consequently, the turbo-charger is disposed immediately over a coupler.

Such a personal watercraft provided with a turbo-charger, however, has an inconvenience wherein, as described above, water dispersed by the coupler directly comes into contact with the turbo-charger, so that a casing of the turbo-kept charger kept at a high temperature is liable to be thermally fatigued.

Accordingly, a second object of the present invention is to provide an output shaft structure of a personal watercraft, which is capable of suppressing a casing of a turbo-charger from being thermally fatigued.

To achieve the above first object according to the present invention there is provided an output shaft structure of a personal watercraft, wherein an engine is mounted on a watercraft body with a crankshaft of the engine extending along the longitudinal direction of the watercraft body and a shaft of a jet pump is coupled via a coupler to a rear end of the crankshaft in such a manner as to be disposed on an extension of the crankshaft. The output shaft structure includes a coupler cover that is provided for covering the coupler, and piping for cooling water, which is communicated to the jet pump, is fixed onto the coupler cover.

To achieve the above first and second objects of the present invention a turbo-charger is disposed over the coupler, and the piping is fixed onto the coupler cover at a position between the coupler cover and the turbo-charger.

To achieve the above second object of the present invention there is provided an output shaft structure of a personal watercraft, wherein an engine is mounted on a watercraft body with a crankshaft of the engine extending in the longitudinal direction of the watercraft body, a shaft of a jet pump is coupled via a coupler to a rear end of the crankshaft in such a manner so as to be disposed on an extension of the crankshaft, and a turbo-charger is disposed over the coupler. The output shaft structure includes a coupler cover formed into an approximately inverse U-shape in cross-section that is provided for covering the coupler, and the coupler cover is turnable around the shaft of the jet pump.

According to the present invention a rear portion of the coupler cover is connected to a bearing member for turnably supporting the shaft of the jet pump on the watercraft body, a breather hose and/or a grease supply hose are/is connected to the bearing member, and a cutout portion for allowing the turning of the coupler cover without interference with the breather hose and/or grease supply hose is formed in the rear portion of the coupler cover.

According to the output shaft structure of a personal watercraft of the present invention an engine is mounted on a watercraft body with a crankshaft of the engine extending along the longitudinal direction of the watercraft body and a shaft of a jet pump is coupled via a coupler to a rear end of the crankshaft in such a manner as to be disposed on an extension of the crankshaft. This output shaft structure includes a coupler cover that is provided for covering the coupler, and piping for cooling water, which is communicated to the jet pump, is fixed onto the coupler cover. With this structure, even if water, which has been permeated in the watercraft body and comes in contact with the coupler, is dispersed by the coupler, the water thus dispersed can be blocked by the coupler cover provided for covering the coupler.

Since the coupler is covered with the coupler cover, the piping for cooling water does not interfere with the coupler.

Since the dispersal of water is blocked by the coupler cover, the piping is exposed to water to a lesser extent, with a result that the piping is less deteriorated.

Since the piping is fixed on the coupler cover, that is, in a state being floated from the bottom shell, the piping is less exposed to water having been permeated in the watercraft body. As a result, it is possible to more certainly prevent deterioration of the piping.

According to the output shaft structure of a personal watercraft according to the present invention a turbo-charger is disposed over the coupler, and the piping is fixed onto the coupler cover at a position between the coupler cover and the turbo-charger. Accordingly, the output shaft structure has the following functions and effects:

Since the dispersal of water by the coupler is blocked by the coupler cover, the turbo-charger is less exposed to water dispersed by the coupler. As a result, it is possible to improve durability of the turbo-charger.

Also, since the piping is fixed on the coupler cover at a position between the coupler cover and the turbo-charger, it is possible to obtain an effect wherein the piping for cooling water can be disposed by making use of a space between the coupler cover and the turbo-charger. Further, since the piping is disposed on the coupler cover, the piping does not come in contact with the turbo-charger kept at a high temperature, with a result that the piping is less deteriorated.

According to the output shaft structure of a personal watercraft according to the present invention an engine is mounted on a watercraft body with a crankshaft of the engine extending in the longitudinal direction of the watercraft body, a shaft of a jet pump is coupled via a coupler to a rear end of the crankshaft in such a manner as to be disposed on an extension of the crankshaft, and a turbo-charger is disposed over the coupler. This output shaft structure includes a coupler cover formed into an approximately inverse U-shape in cross-section that is provided for covering the coupler, and the coupler cover is turnable around the shaft of the jet pump. With this structure, since the dispersal of water by the coupler is blocked by the coupler cover, the turbo-charger is not exposed to the water dispersed by the coupler. As a result, it is possible to improve the durability of the turbo-charger.

Since the coupler cover is formed into an approximately inverse U-shape and is turnable around the shaft of the jet pump, the coupler cover is removed in a direction perpendicular to the shaft of the jet pump by turning the coupler cover around the shaft of the jet pump.

That is to say, the coupler cover can be removed, in the narrow, restricted inner space of the watercraft body, without movement of the coupler cover in the direction along the shaft of the jet pump and also without interference with the turbo-charger.

Accordingly, only the coupler cover can be removed without removal of the turbo-charger and the coupler can be inspected and repaired.

According to the output shaft structure of a personal watercraft according to the present invention a rear portion of the coupler cover is connected to a bearing member for turnably supporting the shaft of the jet pump on the watercraft body. As a result, the coupler cover can be mounted in a stable state.

Also, in this structure, a breather hose and/or a grease supply hose are/is connected to the bearing member. As a result, expanded air generated in the bearing portion can escape through the breather hose, and/or grease can be supplied to the bearing portion through the grease supply hose.

Further, in this output shaft structure, a cutout portion for allowing the turning of the coupler cover without interference with the breather hose and/or grease supply hose is formed in the rear portion of the coupler cover. As a result, only the coupler cover can be removed by turning the coupler cover without removal of the hose, and the coupler can be inspected and repaired.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the description given hereinbelow and the accompanying drawings which are way of illustration only, and thus are not limitative of the present invention, and wherein:

FIGS. 7*a* to 7*c* are views showing details of the coupler cover 100, wherein FIG. 7*a* is a front view; FIG. 7*b* is a right side view with parts partially cutaway; and FIG. 7*c* is a view seen along an arrow "c" in FIG. 7*a,* with parts partially omitted;

DETAILED DESCRIPTION OF THE PREFERRED EMBODIMENTS

Hereinafter, an embodiment of the present invention will be described with reference to the drawings.

Figure 1:
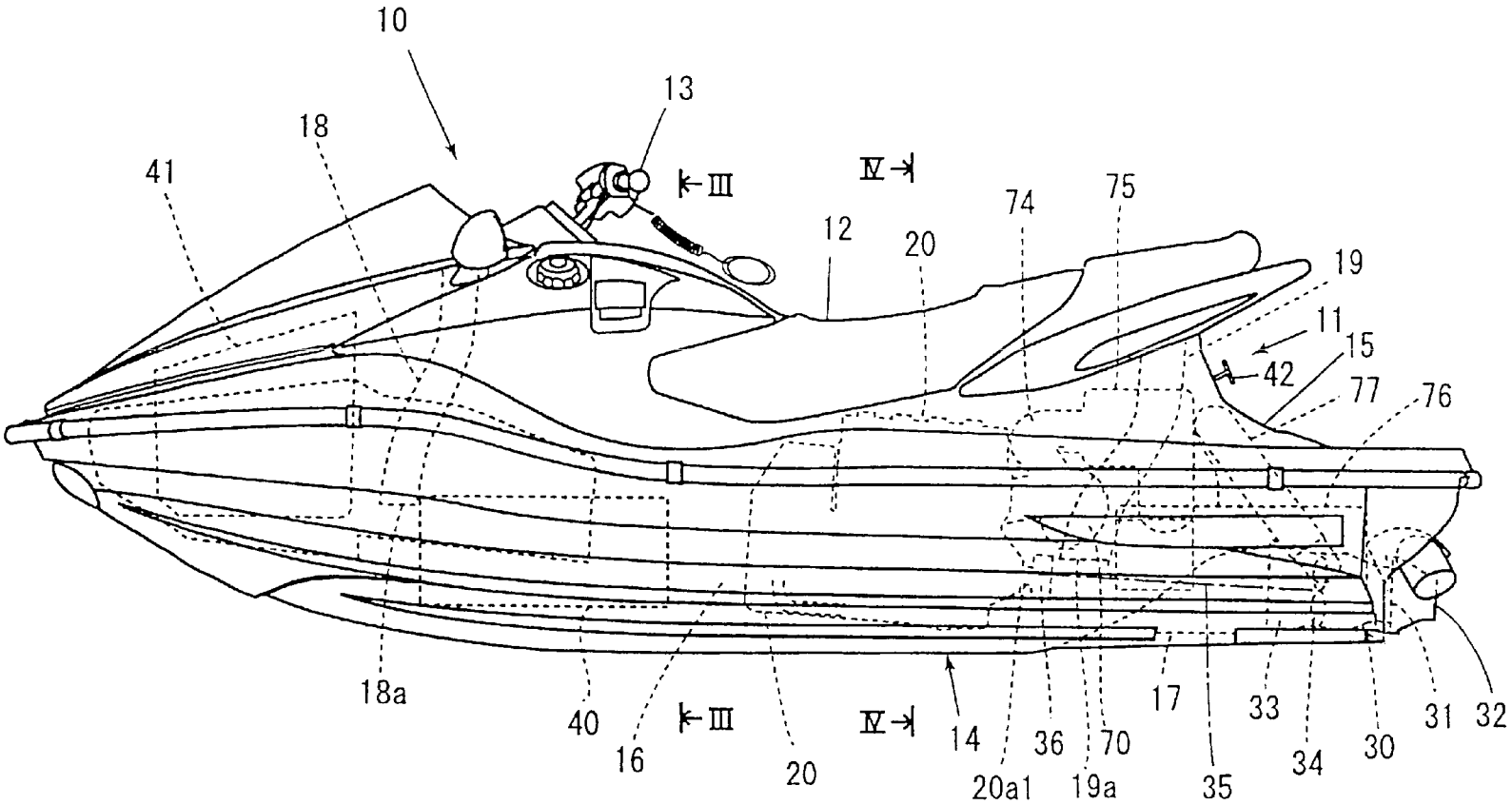
FIG. 1 is a schematic side view showing one example of a personal watercraft to which one embodiment of an output shaft structure of a personal watercraft according to the present invention is applied.
Figure 2:
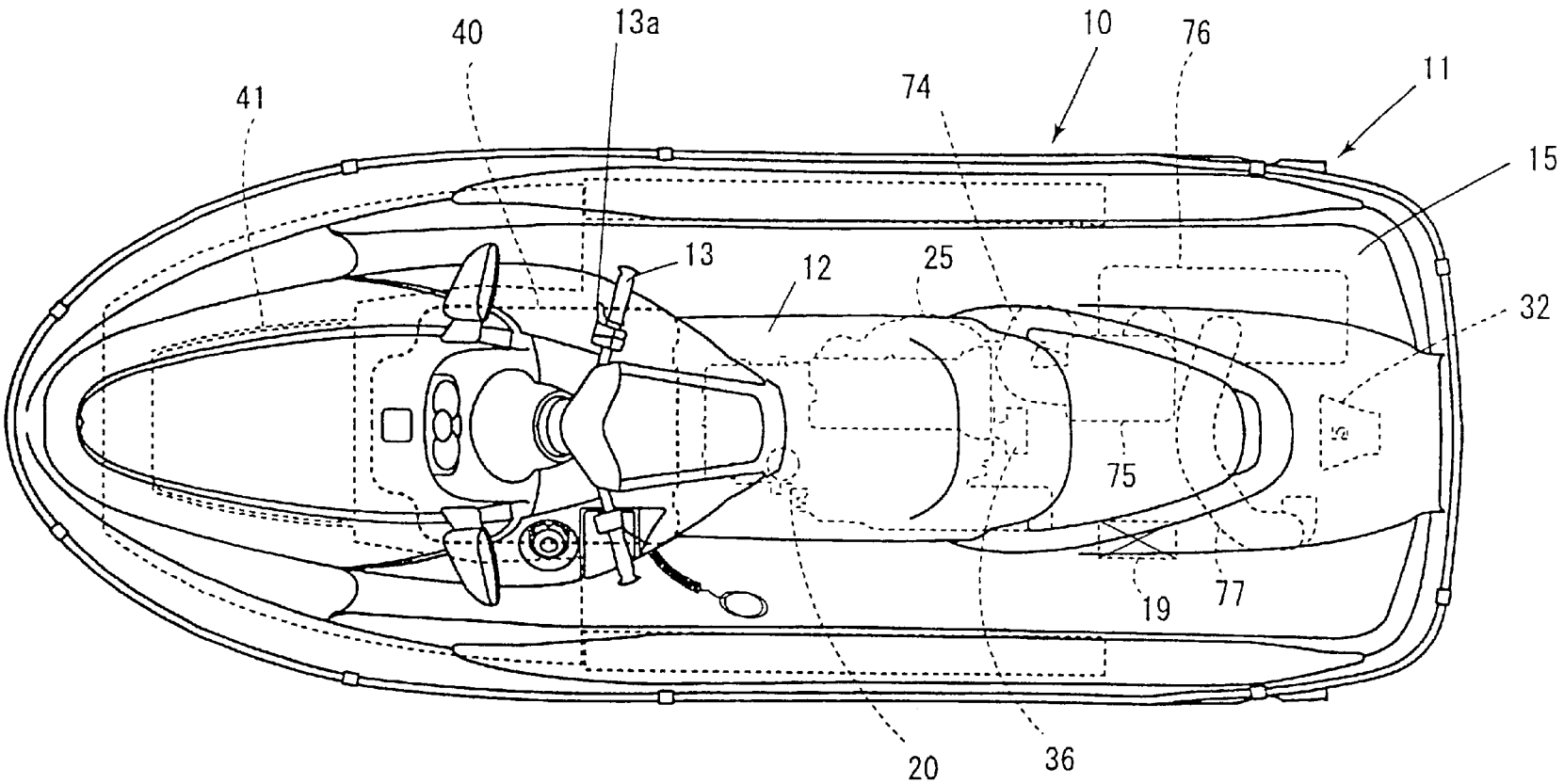
FIG. 2 is a plan view of the personal watercraft.
Figure 3:
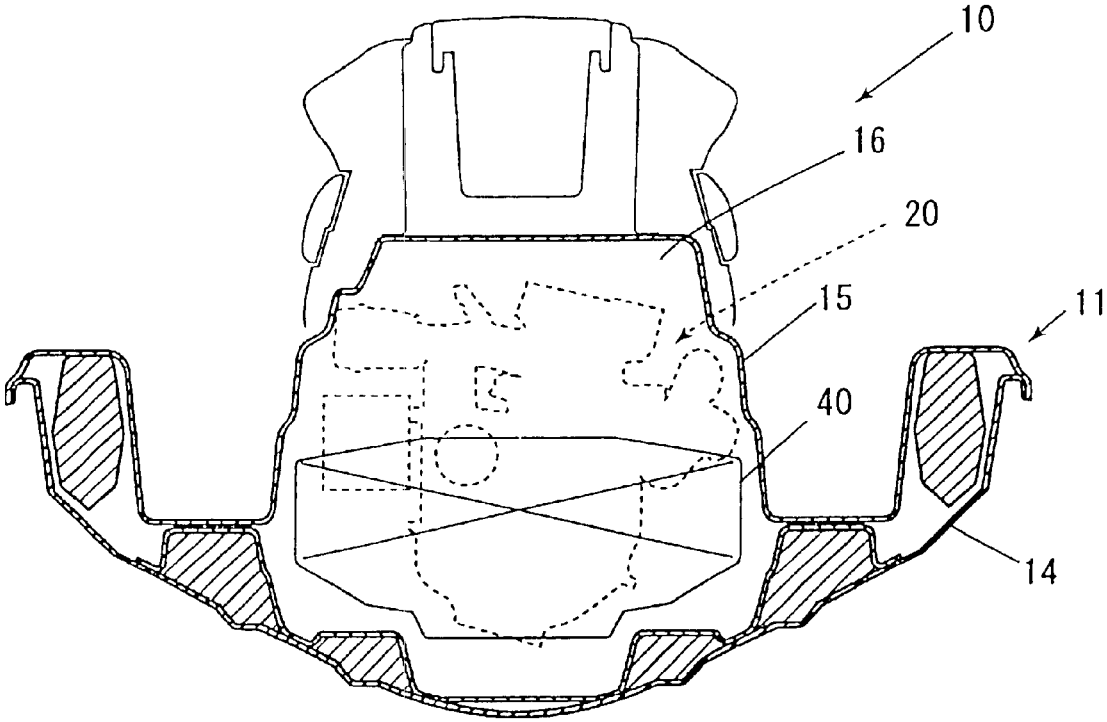
FIG. 3 is a partial, enlarged sectional view taken on line III—III of FIG 1 (with parts partially omitted)

Referring to FIGS. 1–3 (particularly, to FIG. 1), a personal watercraft 10 is a saddle type small watercraft, which is operable by a driver who sits on a seat 12 disposed on a watercraft body 11 while holding a steering handlebar 13 provided with a throttle lever.

The watercraft body 11 has a floating structure wherein a hull 14 is joined to a deck 15 to form a space 16 therein. In the space 16, an engine 20 is mounted on the hull 14, and a jet pump or jet propulsion pump 30 functioning as propulsion means driven by the engine 20 is provided on a rear portion of the hull 14.

Intake ducts 18 and 19 for supplying intake air in the watercraft body 11 (space 16) is provided in the watercraft body 11.

The jet pump 30 (see FIG. 9) has a flow passage 33 extending from a water inlet 17 opened in a bottom shell to both a jet port 31 opened in a rear end portion of the hull 14 and a nozzle 32, and an impeller 34 disposed in the flow passage 33. A shaft 35 of the impeller 34 is coupled to an output shaft 20*a* of the engine 20 via a coupler 36. When the impeller 34 is rotated by drive of the engine 20, water taken in via the water inlet 17 is jetted from the jet port 31 via the nozzle 32, to propel the watercraft body 11. A rotational speed of the engine 20, that is, a propelling force of the jet pump 30 is controlled by a turning operation of a throttle lever 13*a* (see FIG. 2) of the steering handlebar 13. The nozzle 32 is coupled to the steering handlebar 13 via a steering wire (not shown), and is turned by operation of the steering handlebar 13, to change a running course of the watercraft body 11.

In FIGS. 1–3, a fuel tank 40 is positioned adjacent to a containing chamber 41.

Further, a towing hook 42 is used for towing an object (rubber boat or the like). The towing hook 42 is fixed to a rear portion of the watercraft body 11.

Figure 4:
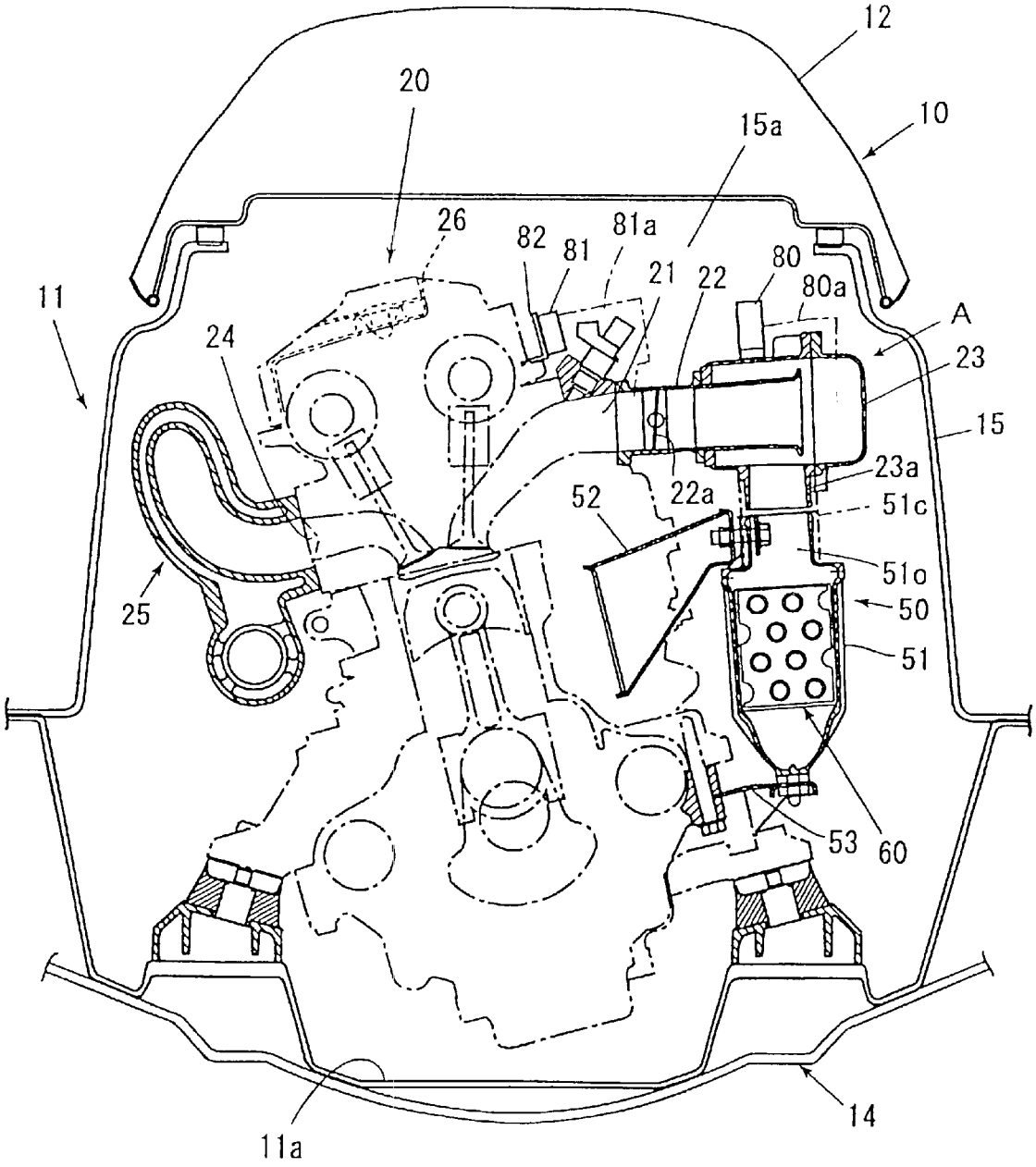
FIG. 4 is a view mainly showing the engine 20, which is a partial, enlarged sectional view taken on line VI—VI of FIG. 1 (with parts partially omitted)
Figure 5:
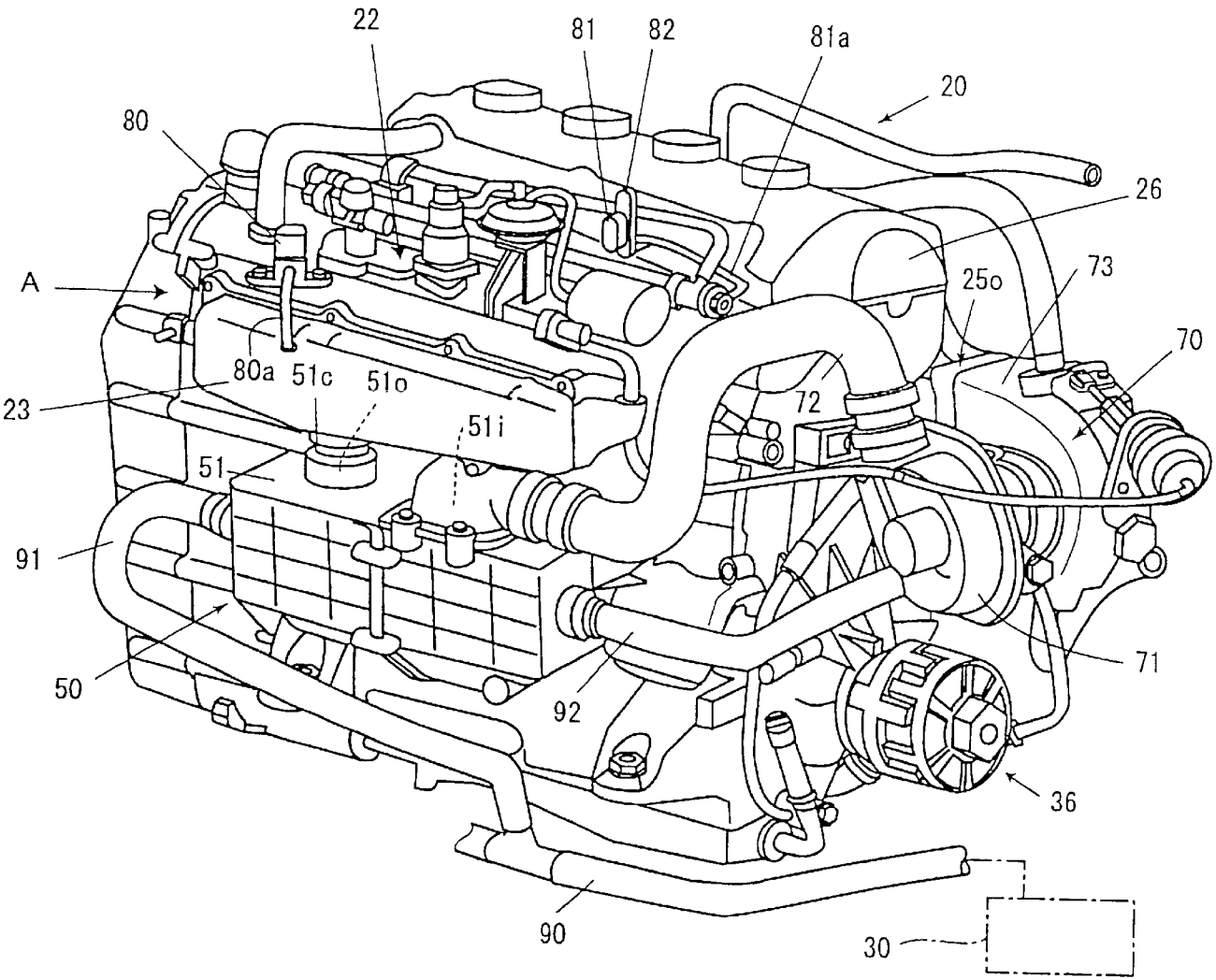
FIG. 5 is a schematic perspective view of the engine 20 as seen from an obliquely rearward direction.
Figure 6:
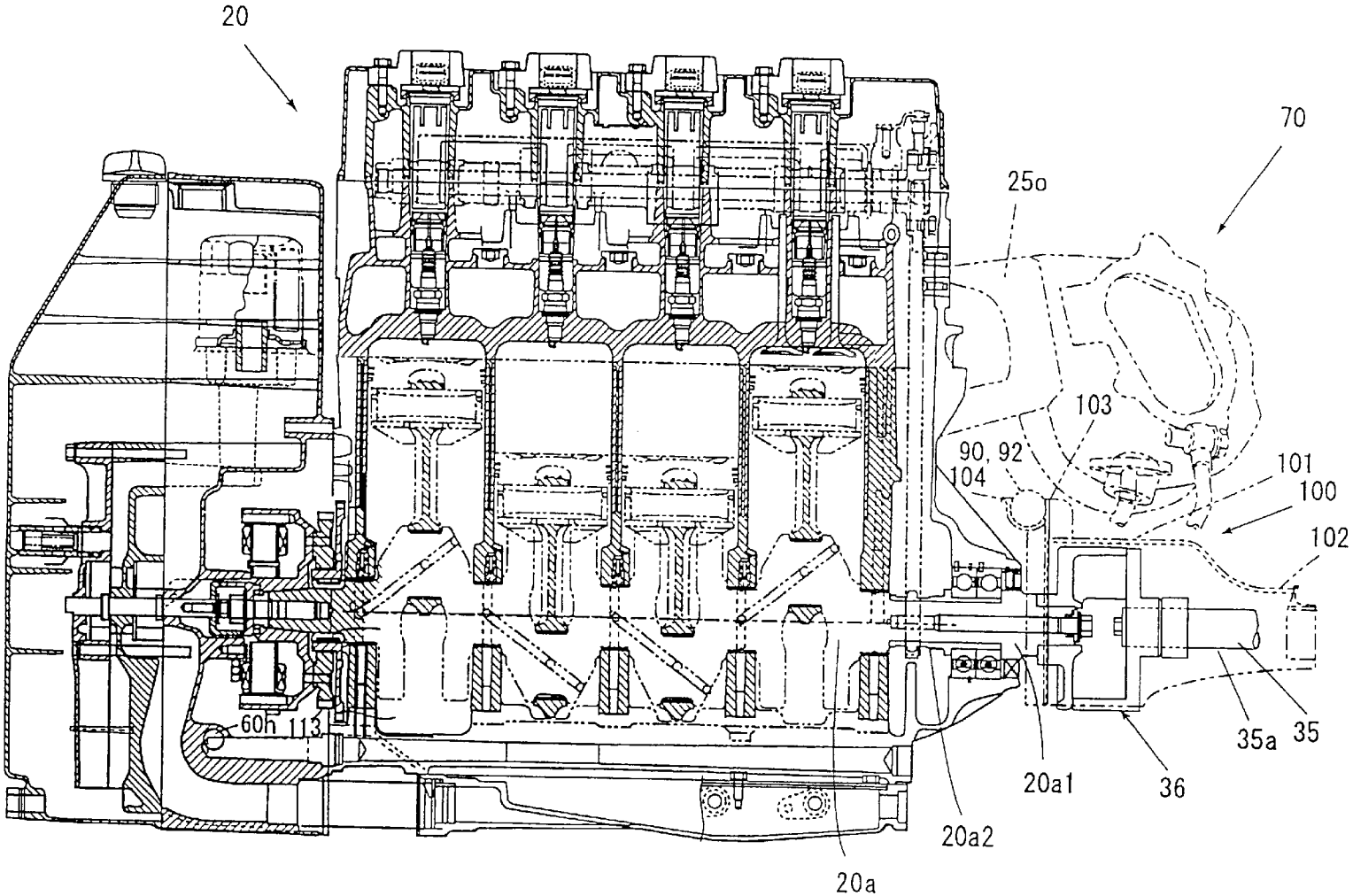
FIG. 6 is a sectional right side view of the engine 20.
Figure 7C:
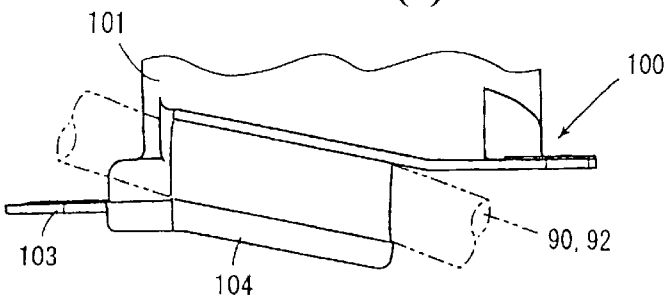
Figure 7B:
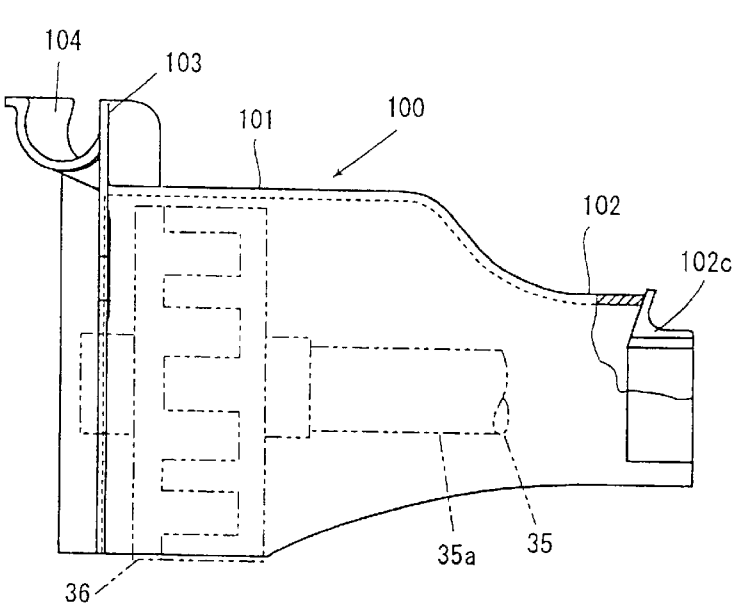
Figure 7A:
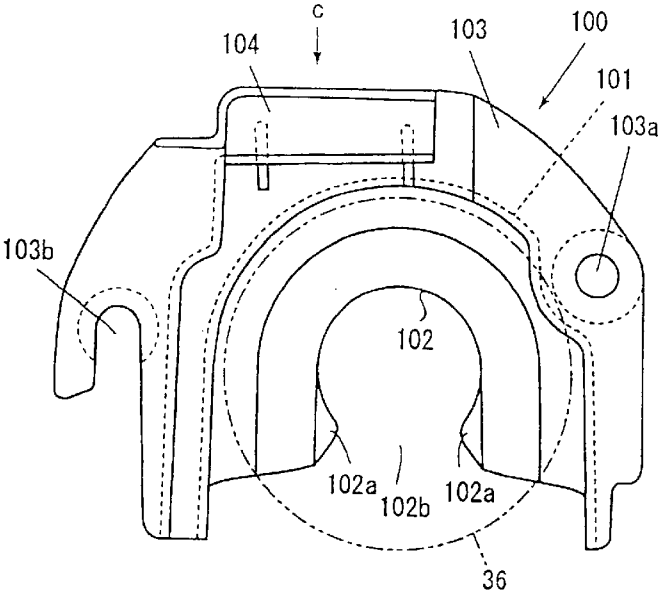
Figure 8:
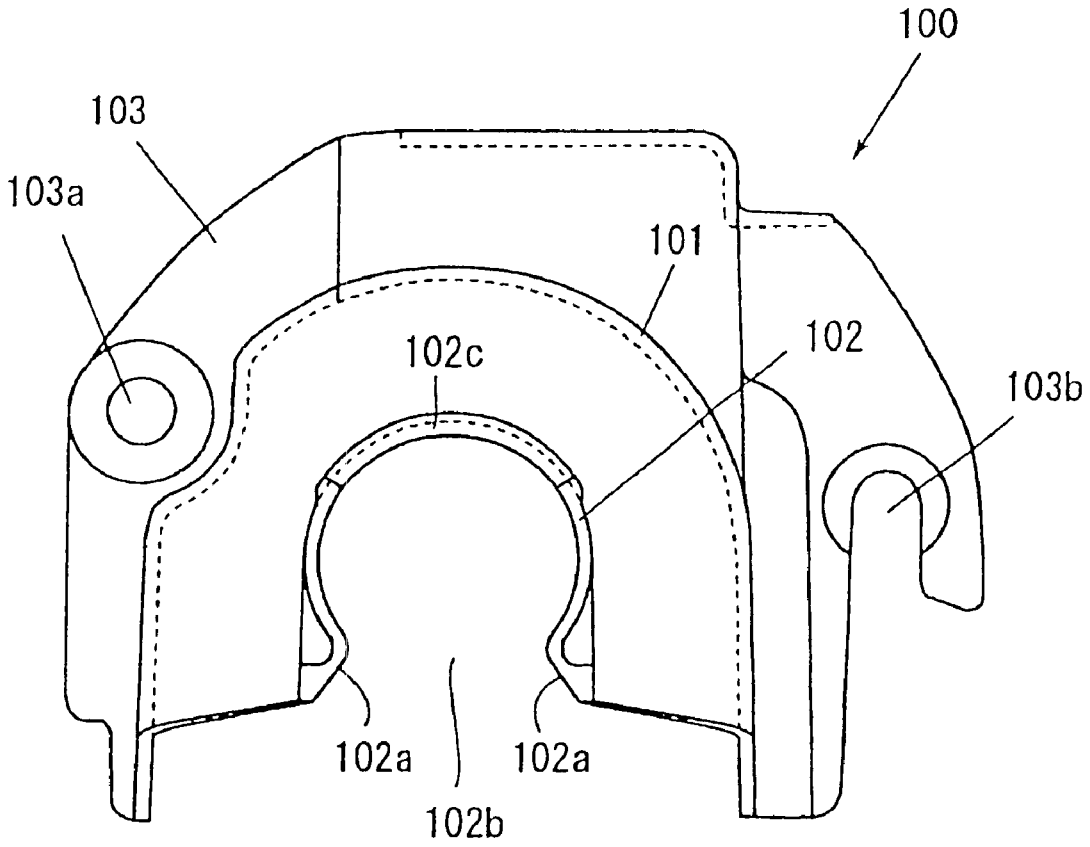
FIG. 8 is a back view of the coupler cover 100 (as seen from the rear side of the watercraft body)

As illustrated in FIGS. 4–6, the engine 20 is a DOHC type in-line four-cylinder/four-cycle engine. As shown in FIG. 1, a crankshaft (see output shaft 20*a*1) of the engine 20 extends along the longitudinal direction of the watercraft body 11. As is apparent from FIG. 4, the engine 20 is mounted on the watercraft body 11 with its vertical axis (center axis) tilted counterclockwise in a front view (FIG. 4).

Referring to FIG. 4, an intake port 21 is disposed on a left side of the engine 20 in the running direction of the watercraft body 11, and an exhaust port 24 is disposed on a right side of the engine 20 in the running direction of the watercraft body 11.

A throttle body 22 and a surge tank (intake chamber) 23, which are communicated to the intake port 21, are connected to the intake port 21. An inter-cooler 50 disposed immediately under the surge tank 23 is connected to the surge tank 23. In FIG. 4, mounting brackets 52 and 53 are mounted to the engine 20, of the inter-cooler 50.

The inter-cooler 50 includes, as shown in FIGS. 4 and 5, a case 51 having an intake inlet 51*i* and an outlet 51*o*, and a cooling unit 60. The intake inlet 51*i* is connected and communicated, via piping 72, to a compressor portion 71 of a supercharger (turbo-charger) 70 disposed immediately behind the engine 20, and the outlet 51*o* is connected, via a tube 51*c*, to an intake inlet 23*a* of the surge tank 23. The cooling unit 60 (see FIG. 4) is a heat exchange unit accommodated in the case 51.

In FIG. 5, cooling water hoses 91 and 92 are connected to the inter-cooler 50.

Referring also to FIG. 4, an exhaust manifold 25 is connected to the exhaust port 24 of the engine 20, and an exhaust outlet 25*o* (see FIG. 5) of the exhaust manifold 25 is connected to a turbine portion 73 of the turbo-charger 70.

In addition, as shown in FIGS. 1 and 2, exhaust gas, which has been used for rotating a turbine in the turbine portion 73, is discharged in water stream generated by the jet pump 30 via an exhaust pipe 74, an anti-counterflow chamber 75 for preventing counterflow of water (permeation of water in the turbo-charger 70 and the like) at the time of turn-over, a water muffler 76, and an exhaust/drainage pipe 77.

Referring to FIGS. 4 and 5, a sensor 80 for air supplied from the supercharger 70 to the surge tank 23 via the inter cooler 50 is provided on an upper portion of the surge tank 23. The throttle body 22 and the surge tank 23 form a horizontal partition assembly A extending, over the engine 20, both in the longitudinal direction and nearly in the horizontal direction. The sensor 80 is located at a position higher than that of the horizontal partition assembly A. The sensor 80 is communicated to the inside of the surge tank 23 via a pipe 80*a*, and is electrically connected to a control circuit (not shown) for the engine. The sensor 80 may be configured as a supercharging pressure sensor for detecting an air pressure (supercharging pressure) in the surge tank 23, or configured as a temperature sensor for detecting a temperature of air in the surge tank 23. Alternately, the sensor 80 may be configured as a supercharging pressure-and-temperature sensor for detecting an air pressure (supercharging pressure) in the surge tank 23 and detecting the temperature of air in the surge tank 23. In the example shown in the figures, only one sensor 80 is depicted. However, both the supercharging pressure sensor for detecting an air pressure (supercharging pressure) in the surge tank 23 and a temperature sensor for detecting the temperature of air in the surge tank 23 may be separately provided on the upper portion of the surge tank 23.

An intake pressure sensor 81 for detecting an intake pressure on the downstream side from a throttle (throttle valve) 22*a* in the throttle body 22 is disposed between a head cover 26 of the engine 20 and the surge tank 23 at a position offset to the head cover 26. The sensor 81 is mounted to the head cover 26 by means of a mounting member 82. As is apparent from FIGS. 4 and 5, the sensor 81 is disposed at a position higher than that of the throttle body 22 (accordingly, higher than that of the horizontal partition assembly A). In addition, the sensor 81 is mounted, by means of the mounting member 82, in a state being floated from an upper surface of the throttle body 22. The sensor 81 is communicated to a portion, on the downstream side from the throttle 22*a* of the throttle body 22, of an intake path, by pipe 81*a*, and is electrically connected to the control circuit (not shown) for the engine.

The above-described sensors 80 and 81 for engine control are provided at positions higher than those of respective openings 18*a* and 19*a*, opened in the watercraft body, of the intake ducts 18 and 19.

As shown in FIG. 4, an opening 15*a* is formed in an upper portion of the deck 15, and the sensors 80 and 81 are aligned to the opening 15*a*. Since the opening 15*a* of the deck 15 is opened when the seat 12, which functions as a lid body removably mounted on the watercraft body 11, is removed from the watercraft body 11, the maintenance of the sensors 80 and 81 and the upper portion of the engine can be easily performed.

As described above and as shown in FIG. 6, the shaft 35 of the jet pump 30 is coupled to a rear end of the crankshaft 20*a* of the engine 20 via the coupler 36 in such a manner as to be disposed on an extension of the crankshaft 20*a*. In particular, according to this embodiment, an output shaft 20*a*1 provided separately from the crankshaft 20*a* is coupled to the rear end of the crankshaft 20*a* via a connection pipe 20*a*2, and the shaft 35 of the jet pump 30 is coupled to a rear end of the output shaft 20*a*1 via the coupler 36.

As is apparent from FIG. 6, the turbo-charger 70 is positioned over the coupler 36.

Referring to FIG. 6, a coupler cover 100 for covering the coupler 36 is provided on a rear portion of the engine 20. It is to be noted that for simplicity of the drawings, the depiction of the coupler cover 100 is omitted in FIGS. 1 to 5.

Referring to FIGS. 7*a* to 7*c* and FIG. 8, the coupler cover 100 has a coupler cover portion 101 formed into an inverse U-shape in cross-section as seen from the front side thereof, a shaft cover portion 102 continuous to a rear portion of the coupler cover portion 101, a flange portion 103 integrally formed on a front portion of the coupler cover portion 101, and a pipe holding portion 104 integrally formed on an upper portion of the flange portion 103.

The flange portion 103 has bolt insertion holes 103*a* and 103*b*, in which bolts (not shown) are to be inserted.

Lower ends of an inner wall surface of a rear portion of the shaft cover portion 102 partially project inwardly, to form a contracted portion 102*b* by two projections 102*a* thus formed.

A partial cutout portion 102*c* is formed in an upper rear portion of the shaft cover portion 102. The cutout portion 102*c* is adapted to allow the coupler cover 100 to be turned around the shaft 35 without interference with a breather hose 18 to be described later (and/or a grease supply hose 116).

Figure 9:
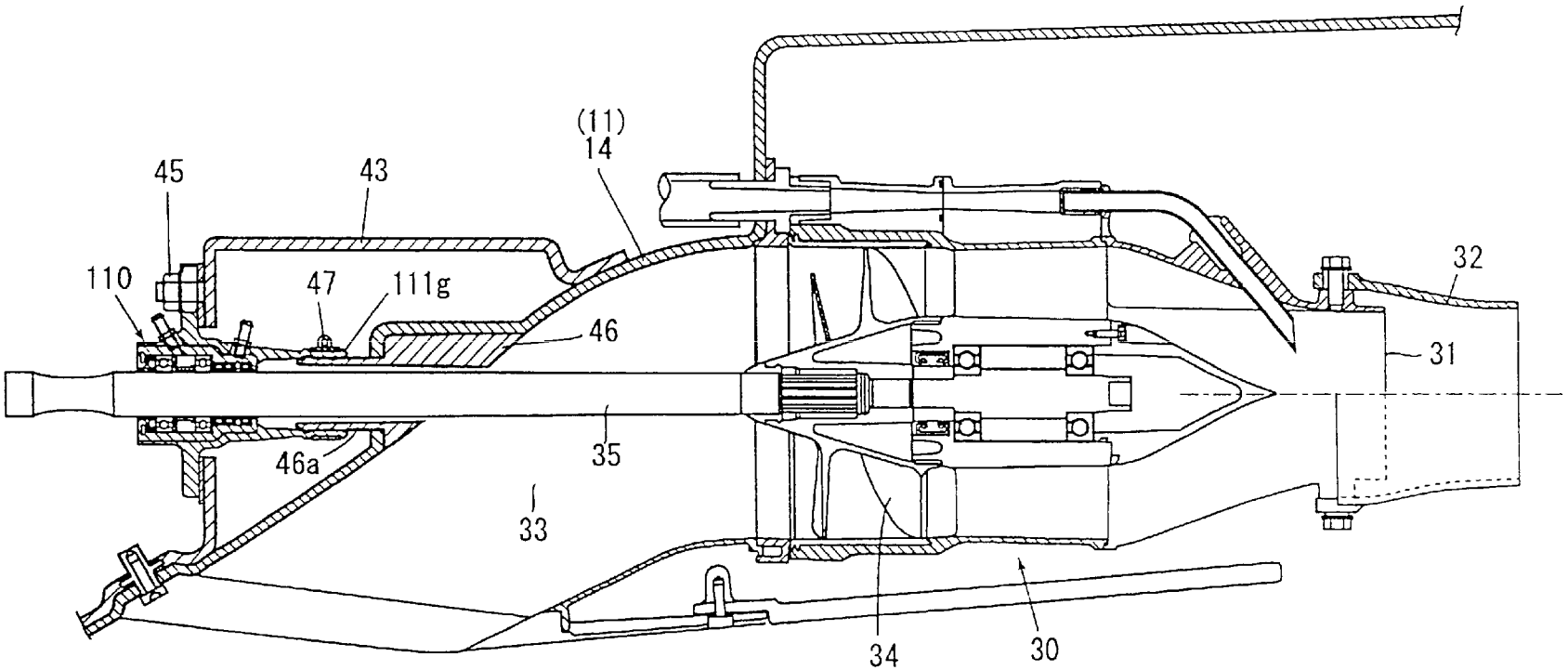
FIG. 9 is a sectional view showing the jet pump 30, and a bearing structure by means of which the shaft 35 of the jet pump 30 is supported by the watercraft body 11 (which is equivalent to a partial, enlarged sectional view of FIG. 1)
Figure 10:
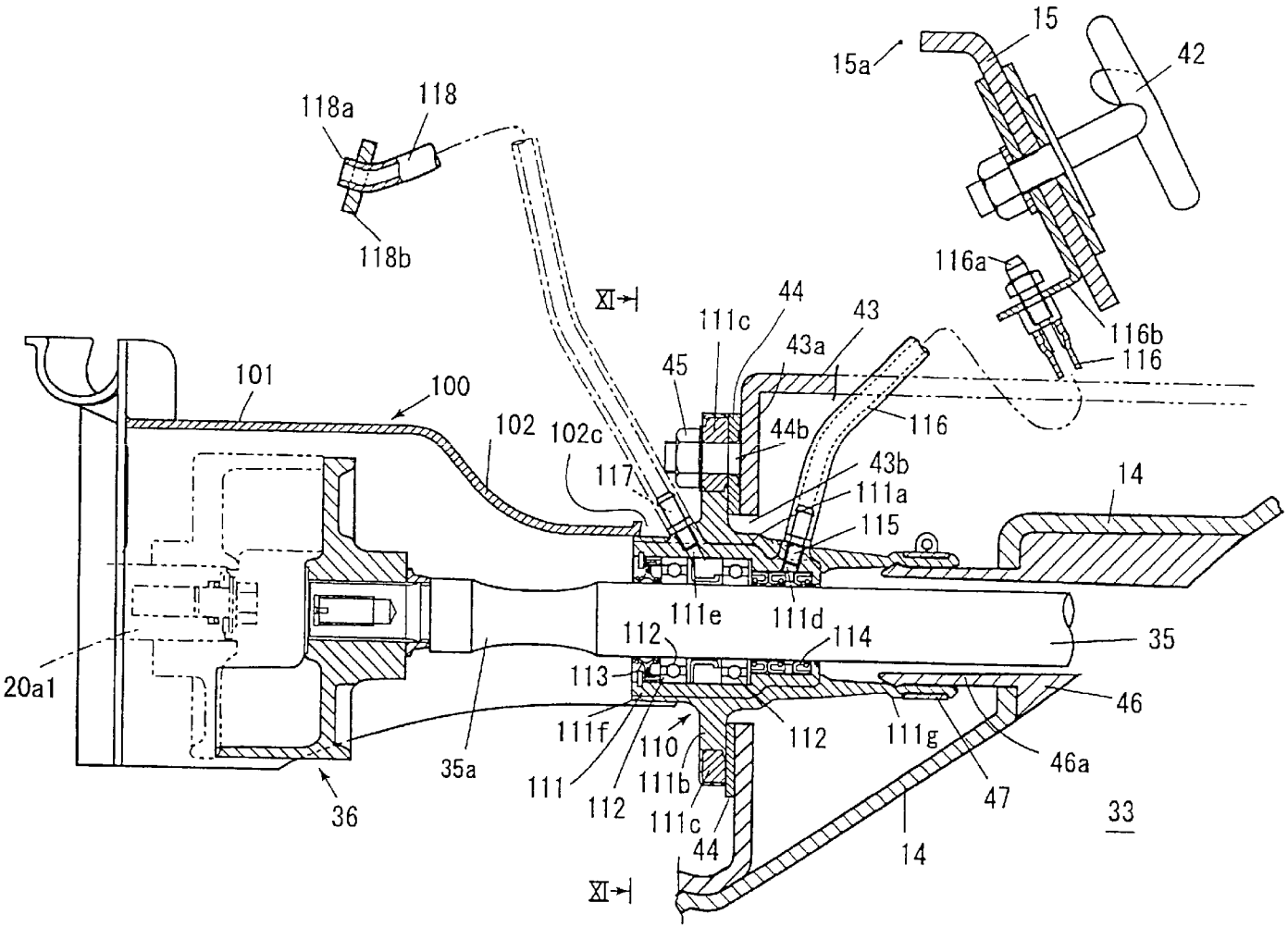
FIG. 10 is a partial, enlarged view of FIG. 9, showing the coupler cover 100 in addition to the components shown in FIG. 9.
Figure 11:
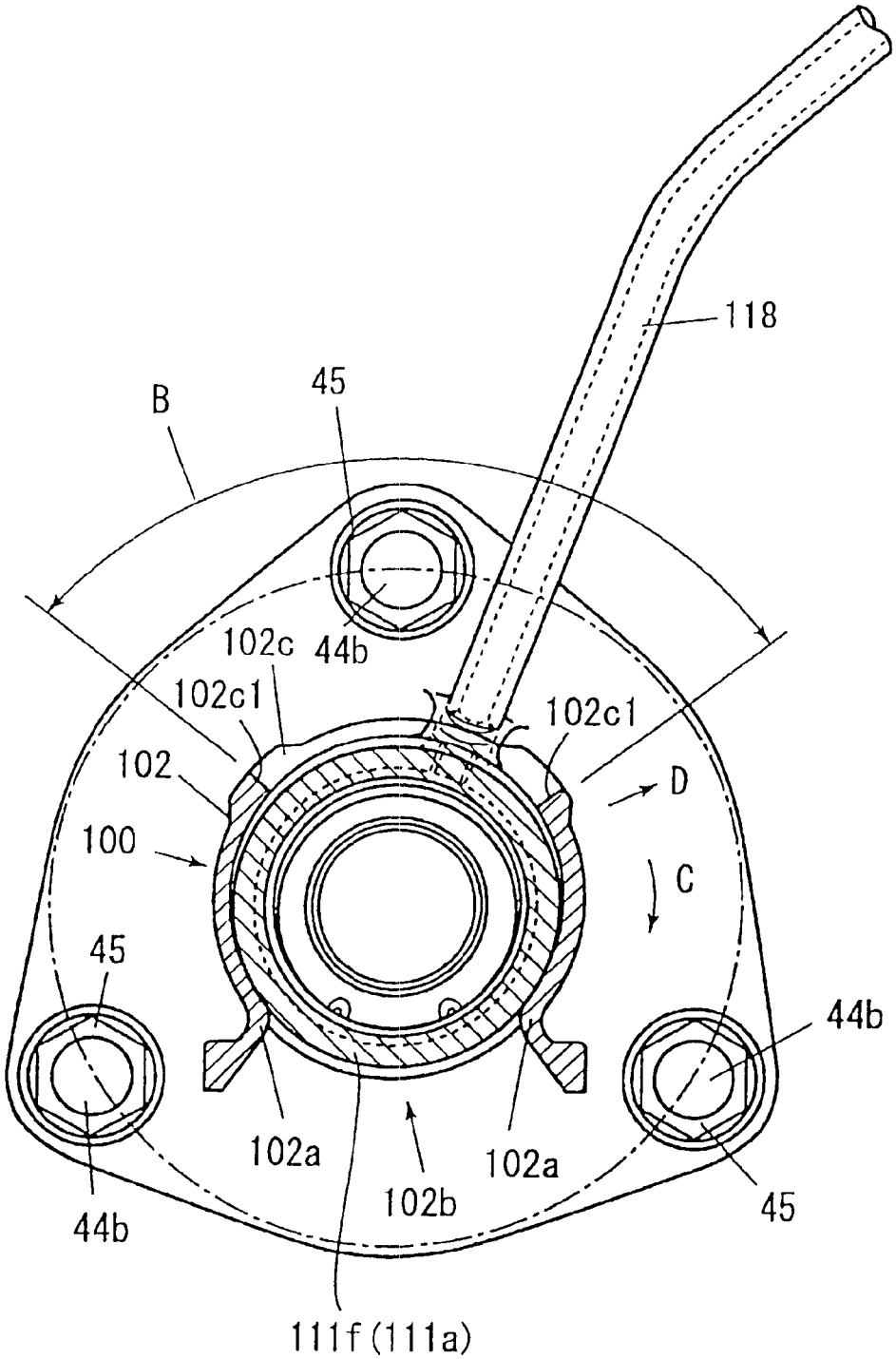
FIG. 11 is a sectional view taken on line XI—XI of FIG. 10.
Figure 12A:
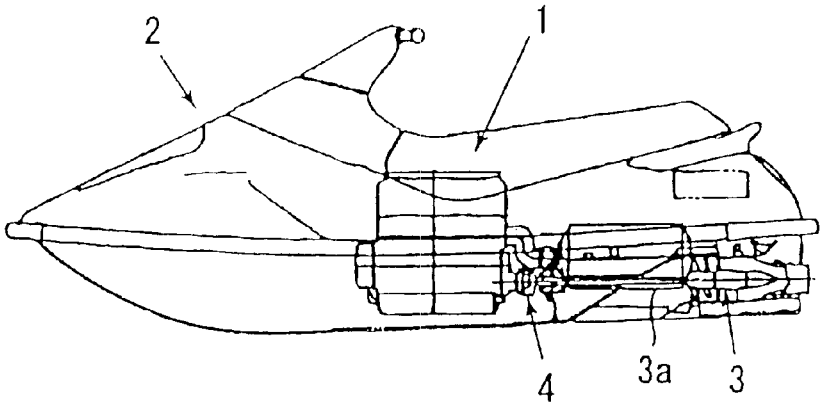
FIG. 12(a) BACKGROUND ART
FIGS. 12*a* and 12*b* are views illustrating a related art personal watercraft.
Figure 12B:
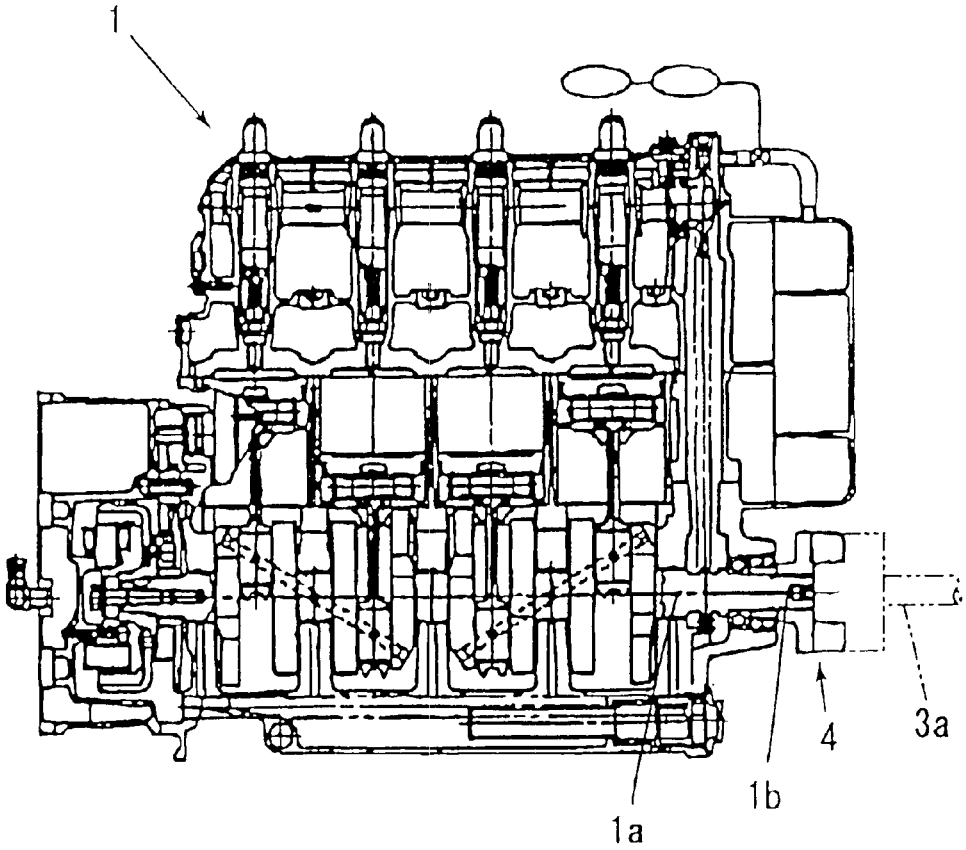
FIG. 12(b) BACKGROUND ART

Referring to FIGS. 9, 10 and 11, a bearing cover 43 is fixed to the hull 14, and a bearing member 110 is fixed to the bearing cover 43.

The bearing member 110 includes a rubber made main body 111, two bearings 112 accommodated in the main body 111, a seal member (oil seal) 113 incorporated in the main body at a position located on the engine side with respect to the bearings 112, and a seal member (water seal) 114 incorporated in the main body 111 at a position located on the jet pump 30 side (the flow passage 33 side) with respect to the bearings 112.

The main body 111 has a cylindrical portion 111*a*, and a flange portion 111*b* integrated with the cylindrical portion 111*a*. The bearings 112, the oil seal 113, and the seal member 114 are incorporated in the cylindrical portion 111*a*.

A metal made reinforcing member 111*c* is integrally buried in the flange portion 111*b*.

A front wall 43*a* of the bearing cover 43 has a hole 43*b* in which the cylindrical portion 111*a* of the bearing member 110 is to be inserted. A ring-shaped metal made base 44 is adhesively bonded around the hole 43*b*. A bolt 44*b* is integrally planted on the base 44.

The bearing member 110 is fixed to the bearing cover 43 by inserting the cylindrical portion 111*a* in the hole 43*b* of the bearing cover 43, inserting the bolt 44*b* in the reinforcing member 111*c* of the flange portion 111*b*, and screwing a nut 45 around the bolt 44*b*, thereby fastening the flange portion 111*b* (accordingly, the reinforcing member 111*c*) to the bearing cover 43.

A rear end 111*g* of the cylindrical portion 111*a* is connected to a cylindrical portion 46*a* of a joint rubber 46, which has been mounted to the hull 14 from the flow passage 33 side, by means of a ring-shaped clamp 47.

The cylindrical portion 111*a* of the bearing member 110 has a grease supply hole 111*d* and a breather hole 111*e*.

The grease supply hose 116 is connected to the grease supply hole 111*d* via a connection pipe 115, and a grease nipple 116*a* is provided at a leading end of the grease supply hole 111*d*. The grease nipple 116*a* is co-fastened, together with the above-described towing hook 42 (see FIG. 1), to a portion, near the opening 15*a*, of the deck 15 by a mounting fixture 116*b*.

Accordingly, by opening the seat 12, grease can be easily supplied from the grease nipple 116*a* to the seal member 114 and the bearings 112 via the grease supply hole 116.

The breather hose 118 is connected to the breather hole 111*e* via a connection pipe 117. A leading end 118*a* of the breather hose 118 is fixed at an appropriate position on the watercraft body 11 (hull 14 or deck 15) by a mounting fixture 118*b*.

Accordingly, expanded air generated in the bearing portion (in this case, in the cylindrical portion 111*a*) is discharged in the watercraft body 11 through the breather hole 111*e*, the connection pipe 117, and the breather hose 118.

In the cylindrical portion 111*a*, by suitably forming the grease passage and the breather passage, the grease supply hose 116 and the breather hose 118 can be reversely mounted (concretely, the grease supply hose 116 can be disposed on a front side of the flange portion 111*b* and the breather hose 118 can be disposed on a rear side of the flange portion 111*b*), or both the grease supply hose 116 and the breather hose 118 can be mounted on the front side of the flange portion 111*b*. Alternately, either the grease supply hose 116 or the breather hose 118 may be mounted to the bearing member 110.

As shown in FIGS. 6, 10 and 11 (particularly, shown by a virtual line in FIG. 6 or shown in FIG. 10), the above-described coupler cover 100 is fixed to the rear portion of the engine 20 in a manner by covering the coupler 36 with the coupler cover portion 101; inserting the shaft 35 and a front portion 111*f* of the cylindrical portion 111*a* of the bearing member 110 in the shaft cover portion 102 in such a manner as to make them pass through the restricted portion 102*b* for giving a click feeling to an operator, thereby covering the front portion 111*f* of the bearing member 110 with the shaft cover portion 102; and inserting bolts (not shown) in the bolt insertion holes 103*a* and 103*b* of the flange portion 103 and fastening leading ends of the bolts to the rear portion of the engine.

In the state where the coupler cover 100 is mounted to the rear portion of the engine 20, the coupler 36 is covered with the coupler cover portion 101, and a front end portion 35*a* of the shaft 35 is covered with the shaft cover portion 102.

A rear portion of the coupler cover 100, that is, a rear portion of the shaft cover portion 102 is in a state connected to the front portion 111*f* of the bearing member 110.

Piping is fitted in the pipe holding portion 104, to be held therein.

The piping to be held by the pipe holding portion 104 can be suitably selected. A cooling water hose 92 for communicating the inter cooler 50 to the water jacket of the turbo-charger cover 70 or a main cooling water hose 90 extending from the jet pump 30 to the engine 20, which hose is shown in FIG. 5, can be held by the pipe holding portion 104.

The coupler cover 100 can be turned around the shaft 35 by removing the mounting bolts by means of which the coupler cover 100 is mounted to the engine 20. Since the cutout portion 102*c* for allowing the turning of the coupler cover 100 without interference with the breather hose 118 is formed in the rear portion of the coupler cover 100, the coupler cover 100 can be turned, as shown in FIG. 11, within a range B in which an end portion 102*c*1 of the cutout portion 102*c* does not come in the breather hose 118.

If the mounting of the hose to the pipe holding portion 104 obstructs the turning of the coupler cover 100, the hose may be removed from the pipe holding portion 104.

The output shaft structure of a personal watercraft configured as described above has the following functions and effects:

The engine 20 is mounted on the watercraft body 11 with the crankshaft 20*a* of the engine 20 extending along the longitudinal direction of the watercraft body 11 and the shaft 35 of the jet pump 30 is coupled via the coupler 36 to the rear end of the crankshaft 20*a* of the engine 20 in such a manner as to be disposed on an extension of the crankshaft 20*a*. This output shaft structure includes the coupler cover 100 that is provided for covering the coupler 36, and piping 90 (or 92) for cooling water, which is communicated to the jet pump 30, is fixed onto the coupler cover 100. With this structure, even if water, which has been permeated in the watercraft body 11 and comes in contact with the coupler 36, is dispersed by the coupler 36, the water thus dispersed can be blocked by the coupler cover 100 provided for covering the coupler 36.

Since the coupler 36 is covered with the coupler cover 100, the piping 90 (or 92) for cooling water does not interfere with the coupler 36.

Since the dispersal of water is blocked by the coupler cover 100, the piping 90 (or 92) is less exposed to water, with a result that the piping 90(92) is less deteriorated.

Since the piping 90 (92) is fixed on the coupler cover 100, that is, in a state being floated from the bottom shell 11*a* (see FIG. 4), the piping 90 (92) is less exposed to water having been permeated in the watercraft body 11. As a result, it is possible to more certainly prevent deterioration of the piping 90 (92).

The turbo-charger 70 is disposed over the coupler 36, and the piping 90 (92) is fixed onto the coupler cover 100 at a position between the coupler cover 100 and the turbo-charger 70. Accordingly, the output shaft structure has the following functions and effects:

Since the dispersal of water by the coupler 36 is blocked by the coupler cover 100, the turbo-charger 70 is not exposed to water dispersed by the coupler 36. As a result, it is possible to improve durability of the turbo-charger 70.

Also, since the piping 90 (92) is fixed on the coupler cover 100 at a position between the coupler cover 100 and the turbo-charger 70, it is possible to obtain an effect wherein the piping 90 (92) for cooling water can be disposed by making use of a space between the coupler 36 and the turbo-charger 70. Further, since the piping 90 (92) is disposed on the coupler cover 100, the piping 90 (92) does not come in contact with the turbo-charger 70 kept at a high temperature, with a result that the piping 90 (92) is less deteriorated.

The coupler cover 100 is formed into an approximately inverse U-shape and is turnable around the shaft 35 of the jet pump 30, the coupler cover 100 is removed in a direction perpendicular to the shaft 35 of the jet pump 30 by turning the coupler cover 100 around the shaft 35 of the jet pump 30. In this embodiment, as shown in FIG. 11, the coupler cover 100 can be removed in a direction shown by an arrow D, perpendicular to the shaft 35, by turning the coupler cover 100 in a direction shown by an arrow C (in the direction where the coupler cover 100 does not interfere with the turbo-charger 70).

That is to say, the coupler cover 100 can be removed, in the narrow, restricted inner space 16 of the watercraft body, without movement of the coupler cover 100 in the direction along the shaft 35 of the jet pump and also without interference with the turbo-charger 70.

Accordingly, only the coupler cover 100 can be removed without removal of the turbo-charger 70 and the coupler 36 can be inspected and repaired.

Since a rear portion of the coupler cover 100 is connected to a bearing member 110 for turnably supporting the shaft 35 of the jet pump on the watercraft body 11. As a result, the coupler cover 100 can be mounted in a stable state.

The breather hose 118 and the grease supply hose 116 are connected to the bearing member 110. As a result, expanded air generated in the bearing portion 110 can escape through the breather hose 118, and grease can be supplied to the bearing portion 110 through the grease supply hose 116.

The cutout portion 102*c* for allowing the turning of the coupler cover 100 without interference with the breather hose 118 is formed in the rear portion of the coupler cover 100. As a result, only the coupler cover 100 can be removed by turning the coupler cover 100 without removal of the breather hose 118, and the coupler 36 can be inspected and repaired.

In the case where the grease supply hose 116 is mounted on the front side of the flange portion 111*b* in place of the breather hose 118, or the breather hose 118 and the grease supply hose 116 are mounted on the front side of the flange portion 111*b* as described above, only the coupler cover 100 can be removed by turning the coupler cover 100 without removal of the grease supply hose 116 and/or the breather hose 118 as described above with the aid of the cutout portion 102*c,* and the coupler 36 can be inspected and repaired.

The throttle body 22 and the surge tank 23 form a horizontal partition assembly A extending, over the engine 20, both in the longitudinal direction and nearly in the horizontal direction, and the sensors 80 and 81 for engine control are disposed over the horizontal partition assembly A. As a result, even if the personal watercraft 10 is rapidly turned or significantly rolled in a state that water has been permeated somewhat in the watercraft body 11 and thereby water in the watercraft body 11 is shook to flow to the sensors 80 and 81, the water thus shook is often blocked by the horizontal partition assembly A formed by the throttle body 22 and the surge tank 23 in such a manner as to extend, over the engine 20, both in the longitudinal direction and nearly in the horizontal direction, so that the sensors 80 and 81 are less exposed to such water.

Since the sensors 80 and 81 are provided at positions higher than those of the openings 18*a* and 19*a,* opened in the watercraft body 11, of the intake ducts 18 and 19, even if atmospheric air outside the watercraft body 11 is introduced, together with water (for example, by splashing) into the space 16 of the watercraft body 11 through the intake ducts 18 and 19 during operation of the personal watercraft 10, the sensors 80 and 81 are less exposed to such water.

Since water, which has been permeated in the watercraft body 11, comes in contact with the coupler 36, is dispersed by the coupler 36, the dispersal of water is blocked by the coupler cover 100 provided for covering the coupler 36. As a result, it is possible to certainly suppress the sensors 80 and 81 from being exposed to water.

Accordingly, it is possible to suppress the occurrence of an inconvenience wherein an error signal is inputted from the sensors 80 and 81 to the control unit for the engine control, and hence to ensure proper operation of the engine 20.

While the embodiment of the present invention has been described, the present invention is not limited thereto, and it is to be understood that changes and variations may be made without departing from the scope of the gist of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An output shaft structure of a personal watercraft, wherein an engine is mounted on a watercraft body with a crankshaft of said engine extending along the longitudinal direction of said watercraft body and a shaft of a jet pump is coupled via a coupler to a rear end of said crankshaft in such a manner so as to be disposed on an extension of said crankshaft, said output shaft structure comprising:

a coupler cover provided for covering said coupler; and piping for cooling water in communication with said jet pump, said piping being fixed onto said coupler cover.

2. The output shaft structure of a personal watercraft according to claim 1, wherein a turbo-charger is disposed over said coupler, and said piping is fixed onto said coupler cover at a position between said coupler cover and said turbo-charger.

3. An output shaft structure of a personal watercraft, wherein an engine is mounted on a watercraft body with a crankshaft of said engine extending in the longitudinal direction of said watercraft body, a shaft of a jet pump is coupled via a coupler to a rear end of said crankshaft in such a manner as to be disposed on an extension of said crankshaft, and a turbo-charger is disposed over said coupler, said output shaft structure comprising:

a coupler cover formed into an approximately inverse U-shape in cross-section, said coupler cover being provided for covering said coupler, and said coupler cover is turnable around said shaft of said jet pump.

4. The output shaft structure of a personal watercraft according to claim 3, wherein a rear portion of said coupler cover is connected to a bearing member for turnably supporting said shaft of said jet pump on said watercraft body, a breather hose and a grease supply hose are connected to said bearing member, and a cutout portion for allowing the turning of said coupler cover without interference with said breather hose and grease supply hose being formed in the rear portion of said coupler cover.

5. The output shaft structure of a personal watercraft according to claim 3, wherein a rear portion of said coupler cover is connected to a bearing member for turnably supporting said shaft of said jet pump on said watercraft body, a grease supply hose is connected to said bearing member, and a cutout portion for allowing the turning of said coupler cover without interference with said grease supply hose being formed in the rear portion of said coupler cover.

6. An output shaft structure of a personal watercraft comprising:

a shaft of a jet pump being adapted to be coupled via a coupler to a rear end of a crankshaft and being disposed on an extension of said crankshaft;

a coupler cover provided for covering said coupler; and piping for providing cooling water to be in communication with said jet pump, said piping being fixed onto said coupler cover.

7. The output shaft structure of a personal watercraft according to claim 6, wherein a turbo-charger is disposed over said coupler, and said piping is fixed onto said coupler cover at a position between said coupler cover and said turbo-charger.

8. An output shaft structure of a personal watercraft comprising:

a shaft of a jet pump being adapted to be coupled via a coupler to a rear end of said crankshaft and being disposed on an extension of said crankshaft;

a turbo-charger disposed over said coupler;

a coupler cover formed into an approximately inverse U-shape in cross-section, said coupler cover being provided for covering said coupler, and said coupler cover being turnable around said shaft of said jet pump.

9. The output shaft structure of a personal watercraft according to claim 8, wherein a rear portion of said coupler cover is connected to a bearing member for turnably supporting said shaft of said jet pump on said watercraft body, a breather hose and a grease supply hose are connected to said bearing member, and a cutout portion for allowing the turning of said coupler cover without interference with said breather hose and grease supply hose being formed in the rear portion of said coupler cover.

10. The output shaft structure of a personal watercraft according to claim 8, wherein a rear portion of said coupler cover is connected to a bearing member for turnably supporting said shaft of said jet pump on said watercraft body, a grease supply hose is connected to said bearing member, and a cutout portion for allowing the turning of said coupler cover without interference with said grease supply hose being formed in the rear portion of said coupler cover.

* * * * *